US006942217B2

(12) United States Patent
Cipullo

(10) Patent No.: US 6,942,217 B2
(45) Date of Patent: Sep. 13, 2005

(54) GAME AND METHOD OF PLAYING

(76) Inventor: Fernando Cipullo, 11 Bettoni Aisle, Irvine, CA (US) 92606

( * ) Notice: Subject to any disclaimer, the term of this patent is extended or adjusted under 35 U.S.C. 154(b) by 0 days.

(21) Appl. No.: 10/670,936

(22) Filed: Sep. 25, 2003

(65) Prior Publication Data

US 2004/0119230 A1 Jun. 24, 2004

Related U.S. Application Data

(60) Provisional application No. 60/413,432, filed on Sep. 26, 2002.

(51) Int. Cl.[7] ..... A63F 3/00
(52) U.S. Cl. ..... 273/248; 273/270; 273/281
(58) Field of Search ..... 273/248, 270, 273/281

(56) References Cited

U.S. PATENT DOCUMENTS 3,582,080 A * 6/1971 Schick ..... 273/243
4,226,419 A * 10/1980 Wooden ..... 273/260
4,346,899 A * 8/1982 Nuebling, Sr. ..... 273/244
4,844,473 A * 7/1989 Landsberg ..... 273/264
4,903,969 A * 2/1990 Williams, Jr. ..... 273/248
5,662,328 A 9/1997 Pecoy

* cited by examiner

*Primary Examiner*—Vishu K. Mendiratta
(74) *Attorney, Agent, or Firm*—Knobbe Martens Olson & Bear LLP

(57) ABSTRACT

A new game is provided that involves strategy and racing through the use of game units comprising a plurality of game pieces, wherein the game promotes teamwork and cooperation. This game is governed by at least one rule requiring that the plurality of game pieces of each game unit be within a predetermined number of spaces. Although this rule is a constraint on the movement of the game pieces, this game preferably gives players the opportunity to use this rule as a shield or sword. The game can be played in solitude, but is preferably played with multiple persons. The game ends when a game unit returns to a home position, but the player with the greatest number of points, preferably treats, is the winner.

10 Claims, 11 Drawing Sheets

Reunite your family
at the nearest

Pumpkin Patch

Do not pay or collect

64

FIGURE 5A

You may use this card at anytime
To move any Player
3 spaces forward or backward Pay or Collect

64

FIGURE 5B

Go Back
4
Spaces

64

FIGURE 5C

GAME AND METHOD OF PLAYING

CROSS-REFERENCE TO RELATED APPLICATION

This application claims the benefit of U.S. Provisional Application No. 60/413,432, filed Sep. 26, 2002, the entirety of which is hereby incorporated by reference.

BACKGROUND OF THE INVENTION

1. Field of the Invention

The present invention generally relates to board games and more particularly, to board games that involve a combination of strategy and racing using game units comprising multiple game pieces.

2. Description of the Related Art

Board games have been in existence for centuries. Currently, there are a number of board games that are commercially available. These games typically include game pieces and a board having a relatively flat surface on which the game pieces are played. There are a variety of different games. However, these games can be categorized into two types of board games. One type involves purely strategy. In strategy games, the amount of time it takes a player to win the game is not an objective. Rather, the objective of such games is to defeat the other players by capturing, blocking, or destroying opposing game pieces. The other type involves a form of racing. In racing games, the amount of time it takes a player to win the game is the objective. The first person to cross a finish line or accumulate points is the winner. In both cases, however, the goal is always to defeat the other players.

There are combination board games that involve both strategy and racing. However, such board games are generally limited to a single game piece per player. While some combination board games provide multiple game pieces per player, the player generally would acquire all of his game pieces over the course of the game or would have game pieces without distinguishing marks. For instance, the player may begin with a single game piece. As the game progresses, the player may obtain additional game pieces depending on the player's luck or strategy. Alternatively, the player may start with all of the game pieces. These game pieces, however, have similar characteristics and are not limited by the movement of any particular game piece.

SUMMARY OF THE INVENTION

Accordingly, what is needed is an improved combination board game having game units comprising multiple game pieces that involves multiple players but where the goal is not only to defeat the other players but to compete against oneself by developing an individual strategy for efficiently moving the multiple game pieces as a single game unit. What is also needed is a new combination game where the game pieces per player have varying characteristics. What is further needed is a combination board game where a single game piece of an individual player impacts the movement of the other game pieces of that player such that the game pieces function together as a game unit.

Preferred embodiments of the present invention satisfy the above needs by providing a new combination game that encourages safety and teamwork. The game preferably gives a player multiple game pieces having varying characteristics, wherein the movement of the player's game pieces are restricted when a given game piece is separated from the other game pieces by a predetermined number of spaces on a playing surface.

In one embodiment of the present invention, a game is provided. The game comprises a playing surface, wherein the playing surface has multiple spaces forming a path, wherein each space is sized to accommodate the placement of at least one game piece. The game further comprises a plurality of game units, wherein each game unit has a plurality of game pieces, the movement of which limits the movement of the game unit when a game piece is separated from a particular game piece by a predetermined number of spaces.

In another embodiment of the present invention, the game unit comprises primary and secondary game pieces, wherein the movement of the game unit is limited when the secondary game pieces are separated from the primary game pieces by a predetermined number of spaces.

In another embodiment of the present invention, the game further comprises a plurality of playing cards. Among the playing cards is at least one card with a number for indicating the number of spaces for which at least one game piece of one game unit may move. The playing cards also have at least one card with an image for indicating the rank of a player in relation to the other players.

In another embodiment of the present invention, a method of playing the game is provided. The method comprises selecting a game unit having at least one primary game piece and one secondary game piece, placing the game unit on a space on a playing surface, selecting a playing card from a plurality of playing cards, wherein at least one playing card has a number, moving the at least one game piece and the at least one secondary game piece a certain number of spaces along the playing surface corresponding to the number on the at least one playing card, wherein the certain number of spaces is no greater than the number on the at least one playing card and equaling the total number of spaces moved by the primary game piece and secondary game piece, and restricting movement of a secondary game piece by a predetermined number of spaces.

In another embodiment of the present invention, the method further comprises restricting movement of the at least one primary game piece when a secondary game piece is separated from the at least one primary game piece by a predetermined number of spaces.

These and other features and advantages of the present invention will become apparent to those skilled in the art upon a reading of the following detailed description when considered in connection with the drawings, which show and describe exemplary embodiments of the invention.

BRIEF DESCRIPTION OF THE DRAWINGS

FIG. 5A illustrates a chance card representing a Trick-or-Treat Card in one embodiment of the present invention, wherein the card provides instructions to a player to reunite his family at the nearest Pumpkin Patch space.

FIG. 5B illustrates a chance card representing a Trick-or-Treat Card in one embodiment of the present invention, wherein the card provides an opportunity to a player to move any player's game pieces three spaces forward or backward.

FIG. 5C illustrates a chance card representing a Trick-or-Treat Card in one embodiment of the present invention, wherein the card provides instructions to a player to move his game piece four spaces backward.

DETAILED DESCRIPTION OF THE PREFERRED EMBODIMENT

As shown in FIGS. 1–9, preferred embodiments of the present invention describe an apparatus and method for making and playing a new game having a plurality of game pieces 2, which forms one game unit 4, wherein the game requires that the plurality of game pieces 2 be maintained within a predetermined number of spaces 6 on a playing surface 18. It will be appreciated that multiple variations on the preferred game are contemplated. Accordingly, this invention should not be limited by the description of the preferred embodiments that follow.

Figure 9:
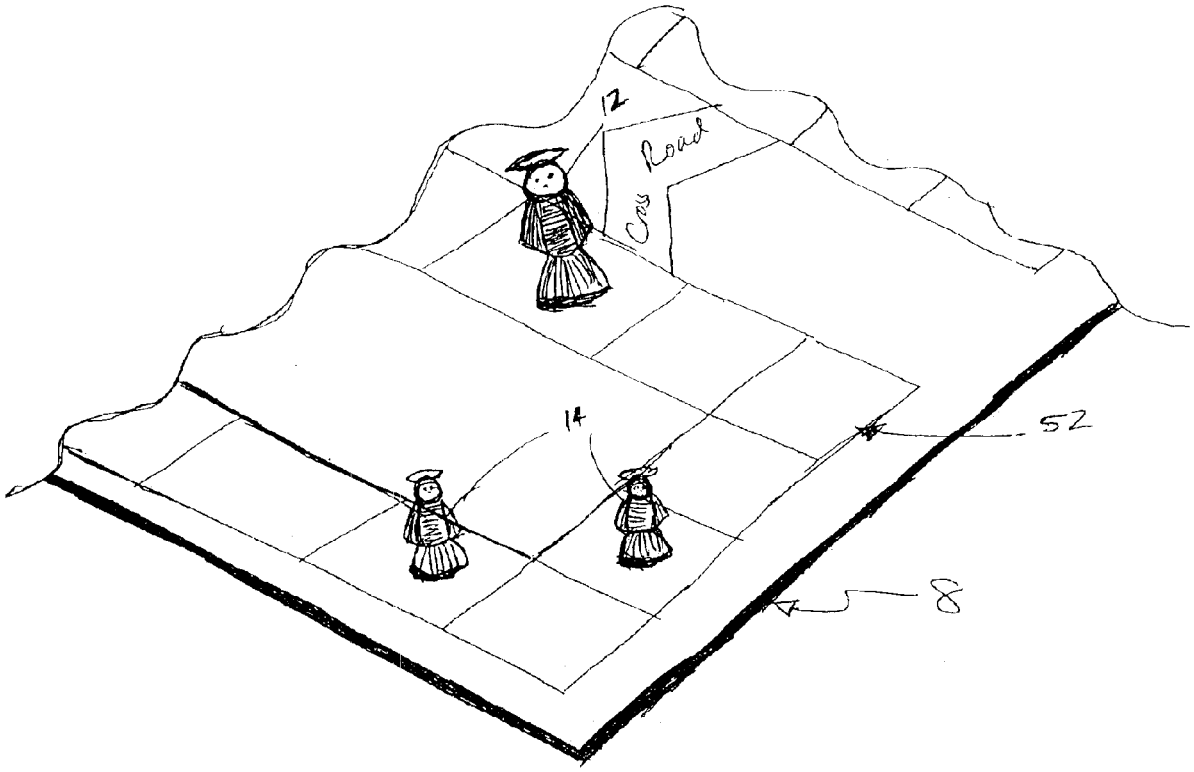
FIG. 9 is a section of a playing surface having playing pieces on spaces in an embodiment of the present invention.

In one embodiment, a game is provided having at least one rule for encouraging safety among family members when engaged in the activity of trick-or-treating. The preferred rule prevents parents and children, represented by primary 12 and secondary game pieces 14, respectively, from separating too far from each other while trick-or-treating. Preferably, the secondary game pieces 14 must be within a predetermined number of spaces of a primary game piece 12 throughout the game. While the predetermined number can be any number of spaces, the number is preferably either four or five spaces as shown in FIG. 9. Although there could be multiple rules that govern an embodiment of the present invention, the term "Safety Rule" as used in this specification refers to a Safety Rule requiring game pieces 2 of a game unit 4 to be within a predetermined number of spaces 6 from each other.

Figure 1A:
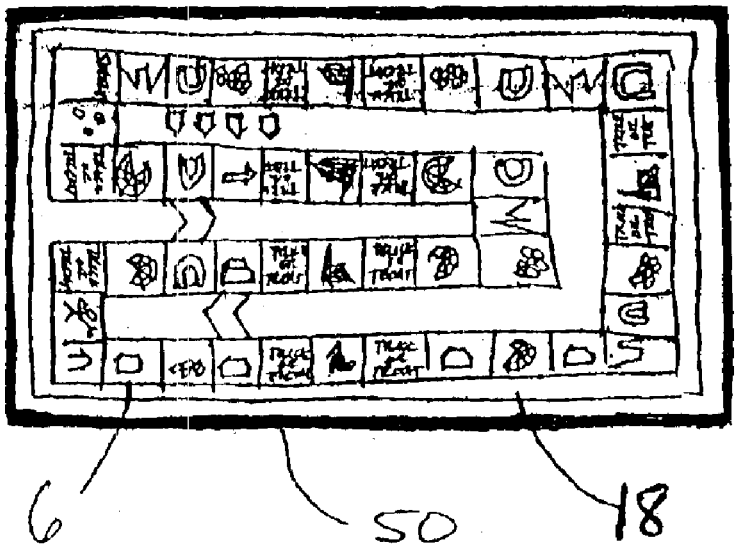
FIG. 1A illustrates a game board having a playing surface with spaces for playing a preferred embodiment of the present invention.
Figure 1B:
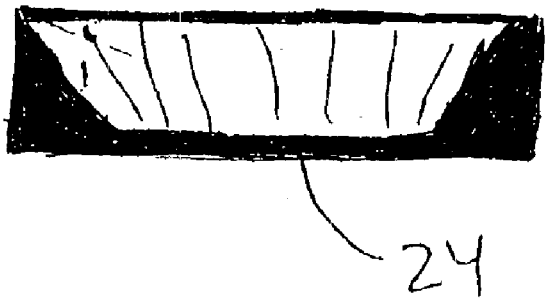
FIG. 1B illustrates a treat holder for collecting treats when playing a preferred embodiment of the present invention.
Figure 1C:
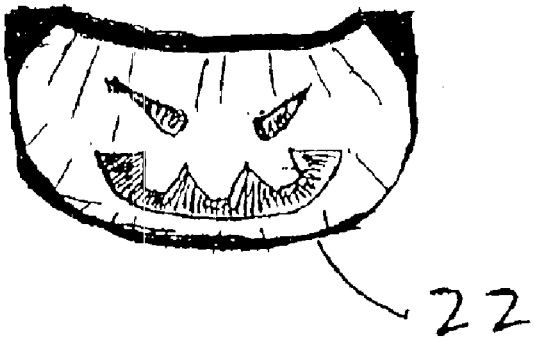
FIG. 1C illustrates a treat basket in a preferred embodiment of the present invention.
Figure 1D:
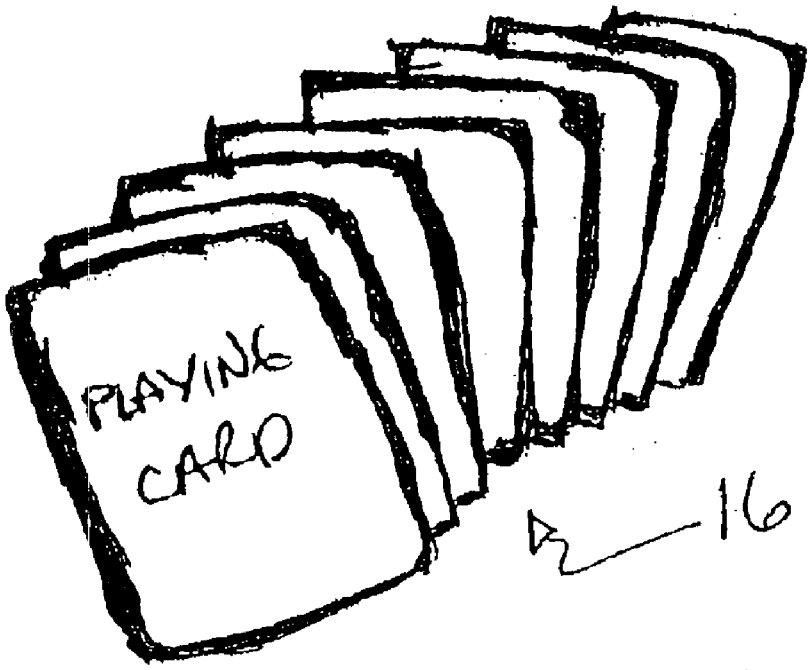
FIG. 1D illustrates playing cards for playing a preferred embodiment of the present invention.
Figure 1E:
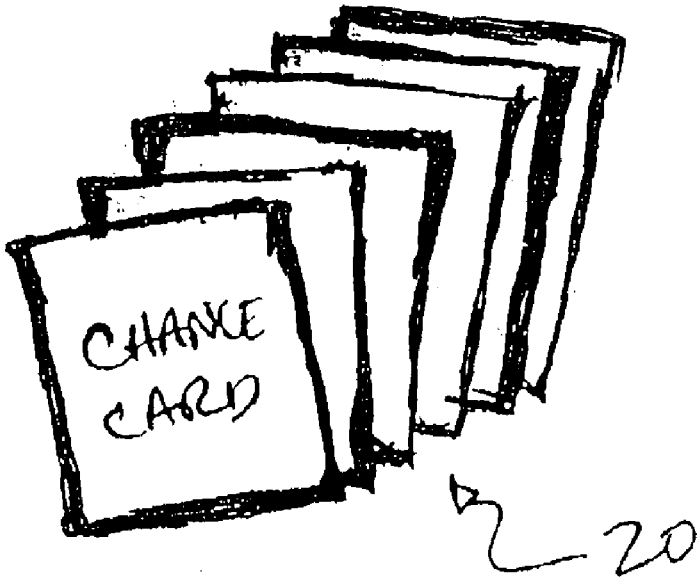
FIG. 1E illustrates chance cards for playing a preferred embodiment of the present invention.

In addition to the Safety Rule, one embodiment, as shown in FIGS. 1A–1F, comprises primary game pieces 12, secondary game pieces 14, a plurality of playing cards 16, a playing surface 18, a plurality of chance cards 20, a basket of treats 22 (preferably four hundred treats), and at least one treat holder 24 (preferably four). While in one embodiment, the game is in a physical environment, it is understood by one of ordinary skill in the art that the game could be in represented and played in an electronic environment. For instance, while the playing surface 18 is shown in FIG. 1A on a game board 50, the playing surface 18 could be an electronic image or on a computer monitor or other such electronic imaging means (e.g., television screen, hologram, projections). Also, although the treats could be candy or any item that is edible or sweet, one of ordinary skill in the art would understand that the treats could be simply points, chips, coins, strips of paper, or other such means of keeping score when the game is in play. Likewise, the basket of treats 22 and the treat holder 24 can be areas on the playing surface for keeping track of or storing the treats.

Figure 1F:
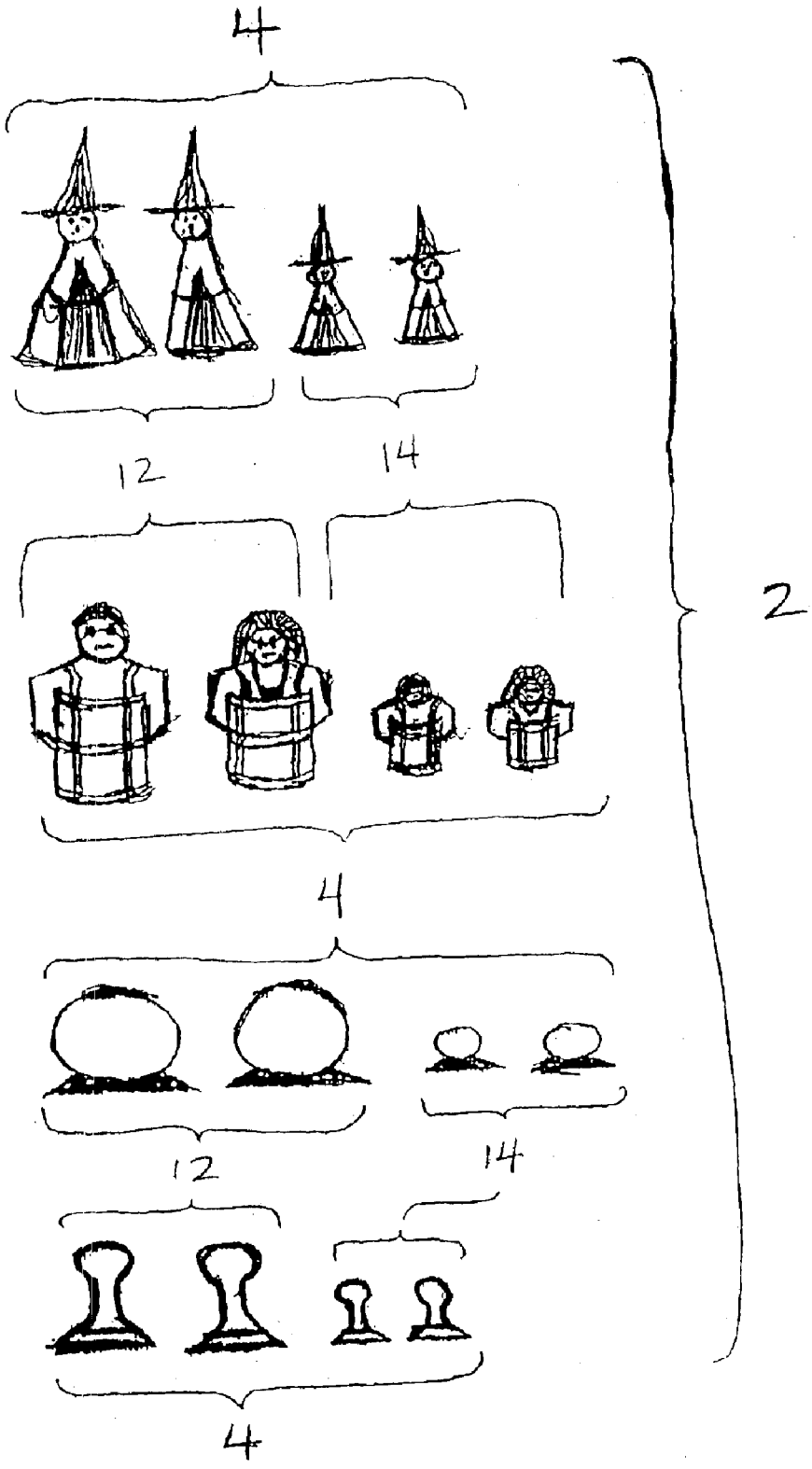
FIG. 1F illustrates game pieces for playing a preferred embodiment of the present invention.

The primary 12 and secondary game pieces 14 form a game unit 4, which represents one family. The game is preferably played with between two to four game units 4 as shown in FIG. 1F. Each of the game units 4 preferably has four game pieces 2, two primary game pieces 12 and two secondary game pieces 14. The primary game pieces 12 are preferably larger than the secondary game pieces 14. Each game unit 4 preferably has at least one unique characteristic that distinguishes one game unit from another game unit. For instance each game unit can be a different color or have a different costume.

Figure 3:
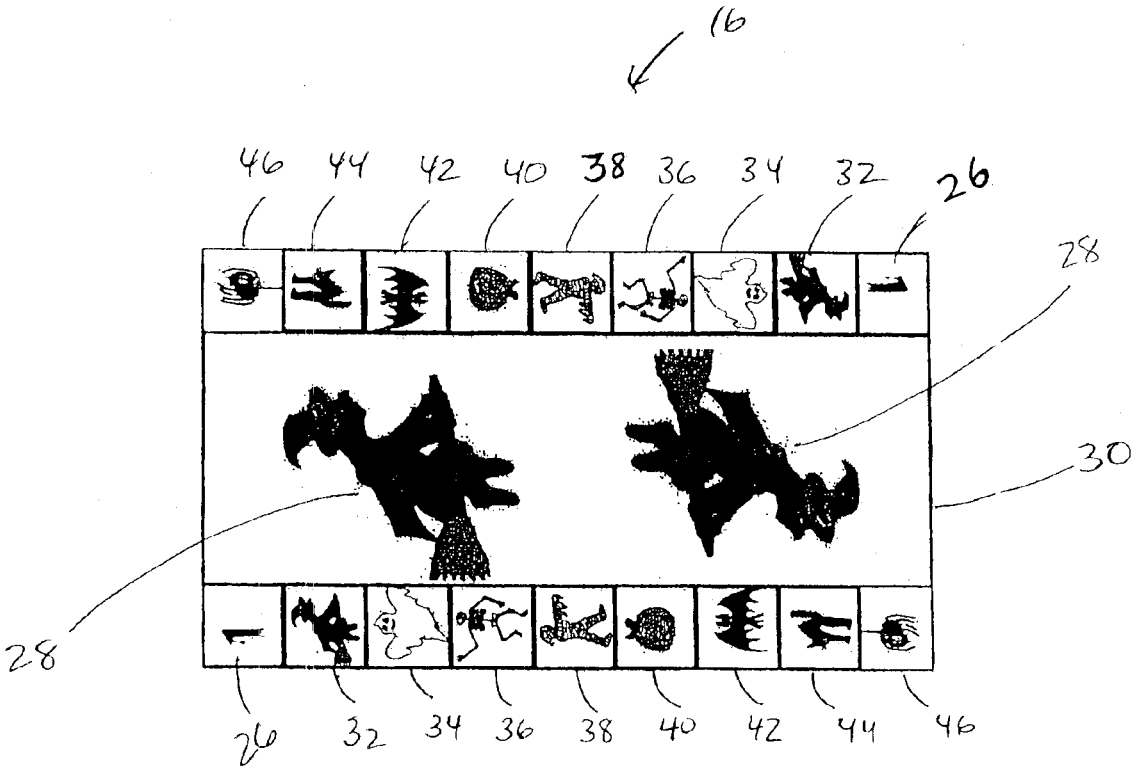
FIG. 3 illustrates a playing card with an image of a pair of witches substantially near the center of the card representing the highest ranked Halloween Card in one embodiment of the present invention.
Figure 4:
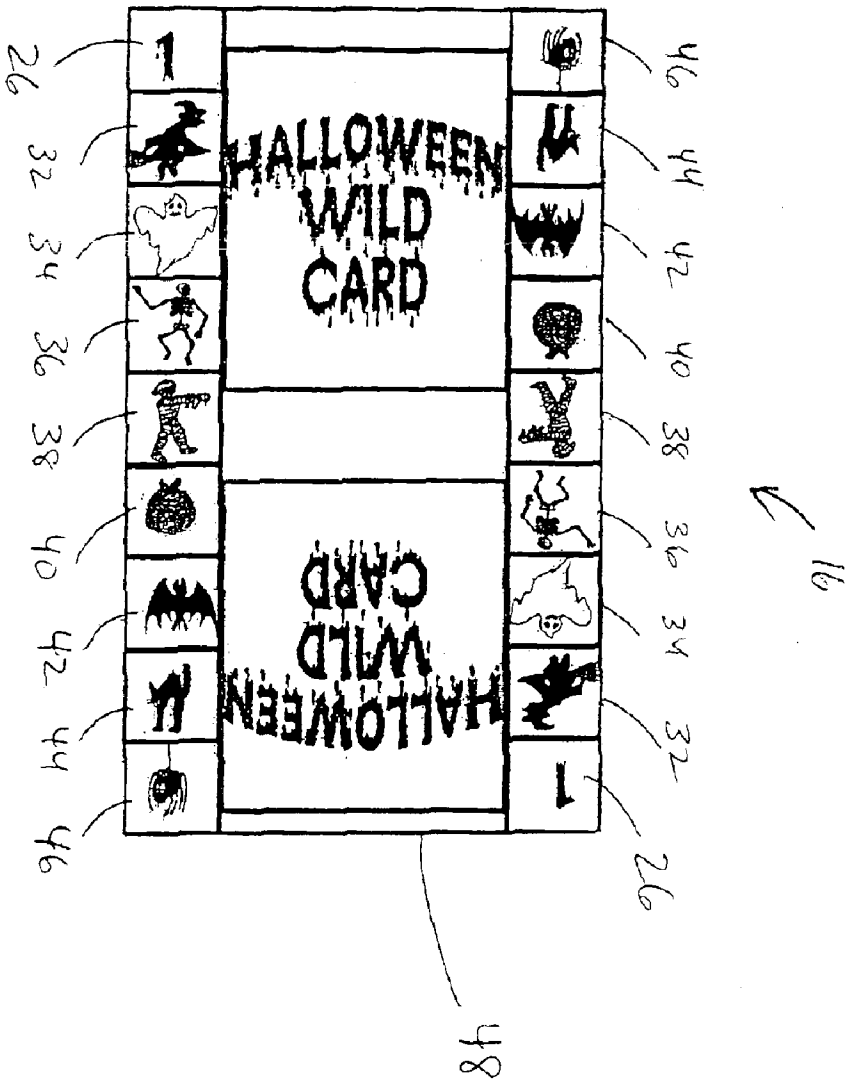
FIG. 4 illustrates a playing card representing a Halloween Wild Card in one embodiment of the present invention.

In addition to game pieces, the game comprises a plurality of playing cards 16 like those shown in FIGS. 3 and 4. There are preferably ninety-eight playing cards 16 with numbers located in the upper left corner of each card 26. These cards 16 are used to indicate the number of spaces a game piece may move and to rank each player. Although these cards 16 are referred to as "Halloween Cards" 30 in one embodiment, these cards can be any means (e.g., die, dial and wheel, spinning top, electronic counter, etc.) for signaling movement or registering a rank. For instance, the cards 16 could be a die with a unique color and number on each surface—the number indicates the number of spaces by which a game piece may move and the color provides a means for ranking each player. However, in the preferred embodiment, each player is ranked according to the image 28 near the center of the Halloween Card 30 as shown in FIG. 3. There are preferably a total of eight different images which are ranked according to the order of the images depicted along the left-hand side of each Halloween Card. The image of the Flying Witch 32 has the highest rank, followed by the Ghost 34, the Skeleton 36, the Mummy 38, the Pumpkin 40, the Bat 42, the Cat 44, and finally the Spider 46, which has the lowest rank of the eight images. The most valuable Halloween Card 30 is the Halloween Wild Card 48 as shown in FIG. 4. The game preferably has two Halloween Wild Cards 48. The Halloween Wild Card 48 may be used immediately or saved by a player for use at a later turn.

Figure 2:
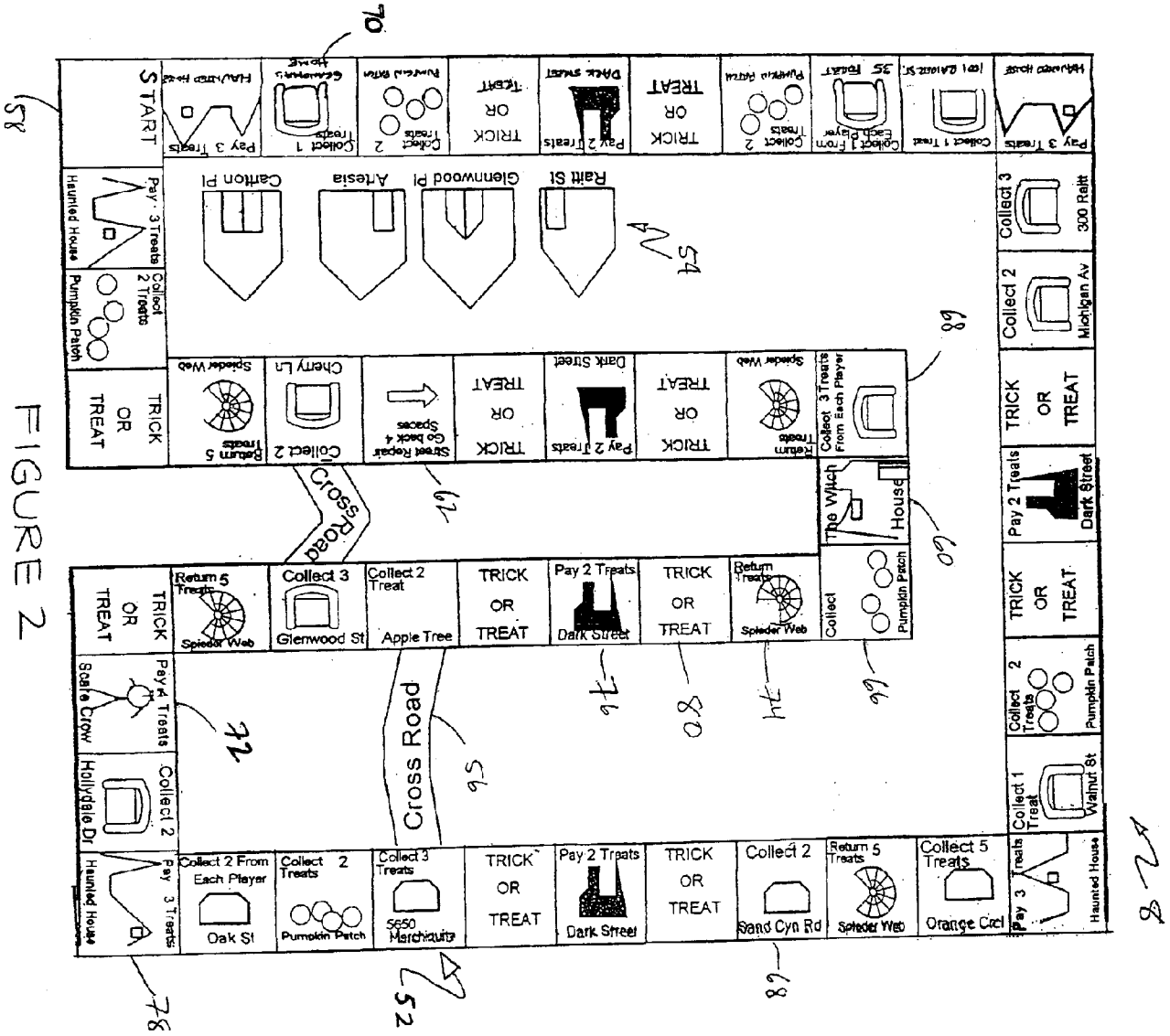
FIG. 2 illustrates a preferred playing surface for playing an embodiment of the present invention.
Figure 8:
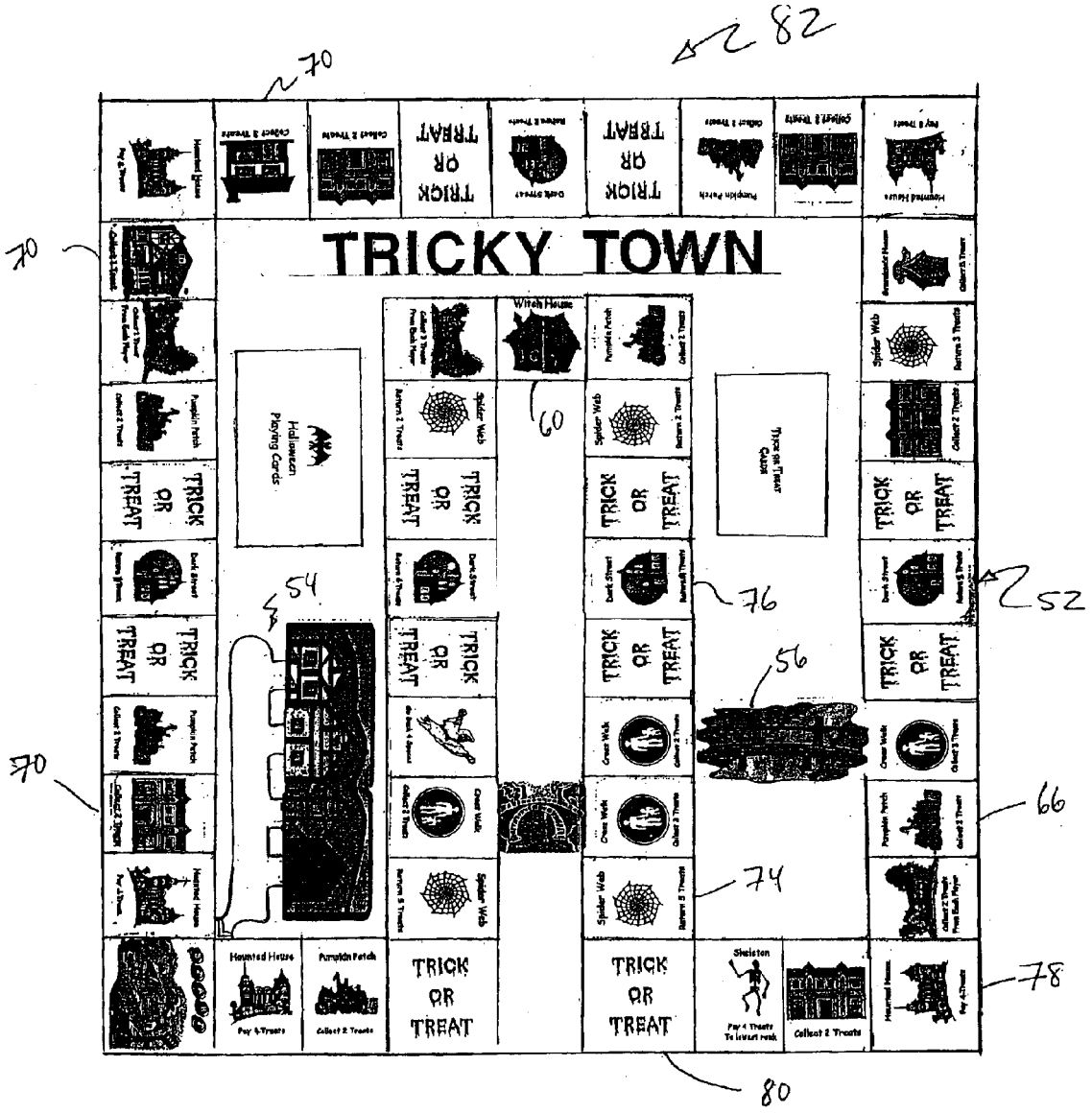
FIG. 8 illustrates an alternative embodiment of a playing surface for playing an embodiment of the present invention.

The game further comprises a game board 50. The game board 50 is approximately 19½ inches by 22 inches. On the board 50 is a surface for playing the game such as the playing surface 8 as shown in FIG. 2 or the playing surface 82 as shown in FIG. 8. Although the playing surface 18 could be a separate element attached or adhered to the game board 50, in an alternative embodiment it could be integral with, molded, or printed on the game board. This surface preferably has spaces 6 that are preferably sized to accommodate at least one game piece 2. These spaces 6 preferably form a path 52 around the board 50. Each of the spaces 6 has an illustration, words, and/or instruction to the player. In the preferred embodiment there are fifty-two spaces on the playing surface 8 representing a neighborhood path 52. In addition to the neighborhood path 52, there are at least four spaces 6 that are preferably illustrated as a row of homes 54 for placing the game units 4 before beginning the game and two Cross Road spaces 56 for bridging sections of the neighborhood path 52 around the board. These Cross Road spaces 56 preferably serve as a means for a player to short cut the entire length of the neighborhood path 52.

Of the fifty-two spaces forming the neighborhood path 52, there are eleven different types of spaces, each type having its own characteristic and purpose. The different types of spaces are distributed throughout the path around the board. These eleven different types of spaces can be further divided into four categories—spaces that (1) impact movement of the game pieces; (2) provide opportunities to obtain treats; (3) causes players to lose treats; and (4) provide opportunities to draw chance cards. Although the following description of the spaces is based on the playing surface 8 shown in FIG. 2, other playing surfaces, such as the playing surface 82 shown in FIG. 8, could be used for playing aspects of the preferred embodiment.

There are three types of spaces that impact movement of the game pieces as shown in FIG. 2—the Start space 58, the Witch House space 60, and the Street Under Repair space 62. The Start space 58 serves as the area where each game unit 4 is placed when the game begins and ends. The Start space 58 is located near the row of homes 54. The game preferably only has one Start space 58. The Witch House space 60 serves as an area that traps game pieces 2. If a game piece 2 lands on or is sent to a Witch House space 60, that game piece 2 must remain at the Witch House space 60 until the rest of the game pieces of the game unit 4 either reaches or passes the Witch House space 60. The term "land on" refers to landing on a space 6 as a direct result of the number of spaces indicated on the Halloween Card 26. The term "sent to" refers to a game piece being sent to a specific neighborhood space 6 as a result of directions on a Trick-or-Treat Card 64 (see below for description of a Trick-or-Treat Card), actions of another player, or directions on a space 6 on the playing surface 8. The game preferably only has one Witch House space 60. The Street Under Repair space 62 serves to move game pieces backwards. If a game piece 2 lands on or is sent to a Street Under Repair space 62, the person playing that game piece must move that game piece back four spaces. The game preferably only has one Street Under Repair space 62.

There are three types of spaces that provide opportunities to obtain or collect treats as shown in FIG. 2—the Pumpkin Patch space 66, the Neighborhood House space 68, and the Grandma's House space 70. The Pumpkin Patch space 66 allows a player whose game piece 2 lands on or is sent to the space to collect two treats from the treat basket 22. The game preferably has six Pumpkin Patch spaces 66. The Neighborhood House space 68 has printed instructions providing a player whose game piece 2 lands on or is sent to the space 68 the opportunity to collect treats from other players or from the treat basket 22. The game preferably has fourteen Neighborhood House spaces 68. The Grandma's House space 70 allows a player whose game piece 2 lands on or is sent to the space to collect one treat from the treat basket 22. The game preferably only has one Grandma's House space 70.

There are four types of spaces that causes players to lose treats as shown in FIG. 2—the Scarecrow space 72, the Spider Web space 74, the Dark Street space 76, and the Haunted House space 78. The Scarecrow space 72 causes a player whose game piece 2 lands on or is sent to the space 72 to lose four treats to the player with the lowest ranked Halloween Card in the round of play 760 or round of draws 670 (see below for the definitions of "round of play" and "round of draws"). The game preferably only has one Scarecrow space 72. The Spider Web space 74 has instructions directing a player whose game piece 2 lands on the space 74 to return a certain number of treats (as indicated on the game board) to the treat basket 22. The game preferably has five Spider Web spaces 74. The Dark Street space 76 causes players whose game piece 2 lands on or is sent to the space 74 to lose two treats to the treat basket 22. The game preferably has five Dark Street spaces 76. The Haunted House space 78 causes a player whose game piece 2 lands on or is sent to this space 78 to lose three treats to another player—either the player who has the lowest ranked Halloween Card in the round of play or the player who intentionally caused the game piece 2 to be moved to the Haunted House space 78.

There is only one type of space as shown in FIG. 2 that provides players with the opportunity to draw chance cards 20—the Trick-or-Treat space 80. The Trick-or-Treat space 80 provides a player whose game piece 2 lands on the space 80 the chance to draw a Trick-or-Treat Card 64. Trick-or-Treat Cards 64 have messages, which direct and/or guide the actions of the player whose game piece 2 lands on the Trick-or-Treat space 80. For instance the Trick-or-Treat Card 64 may have instructions directing the player to move all of the player's game pieces 2 (family) to the nearest Pumpkin Patch space 66 as shown in FIG. 5A or directing the player to move his game pieces 2 a total of four spaces backwards as shown in FIG. 5D. Alternatively, the Trick-or-Treat Card 64 may provide a player the opportunity to save the card 64 to improve his chance of winning the game. For instance, the card 64 could be saved and used to impact the play of another player as shown in FIGS. 5B and 5C, or saved and used to avoid penalties. For instance, if the Trick-or-Treat Card 64 has an image of a flashlight or magic wand, the player can save the card 64 and use the card to avoid losing treats if the player's game piece lands on a Dark Street space 76 or Haunted House space 78. The game preferably has eighty-seven Trick-or-Treat Cards 64.

Figure 6:
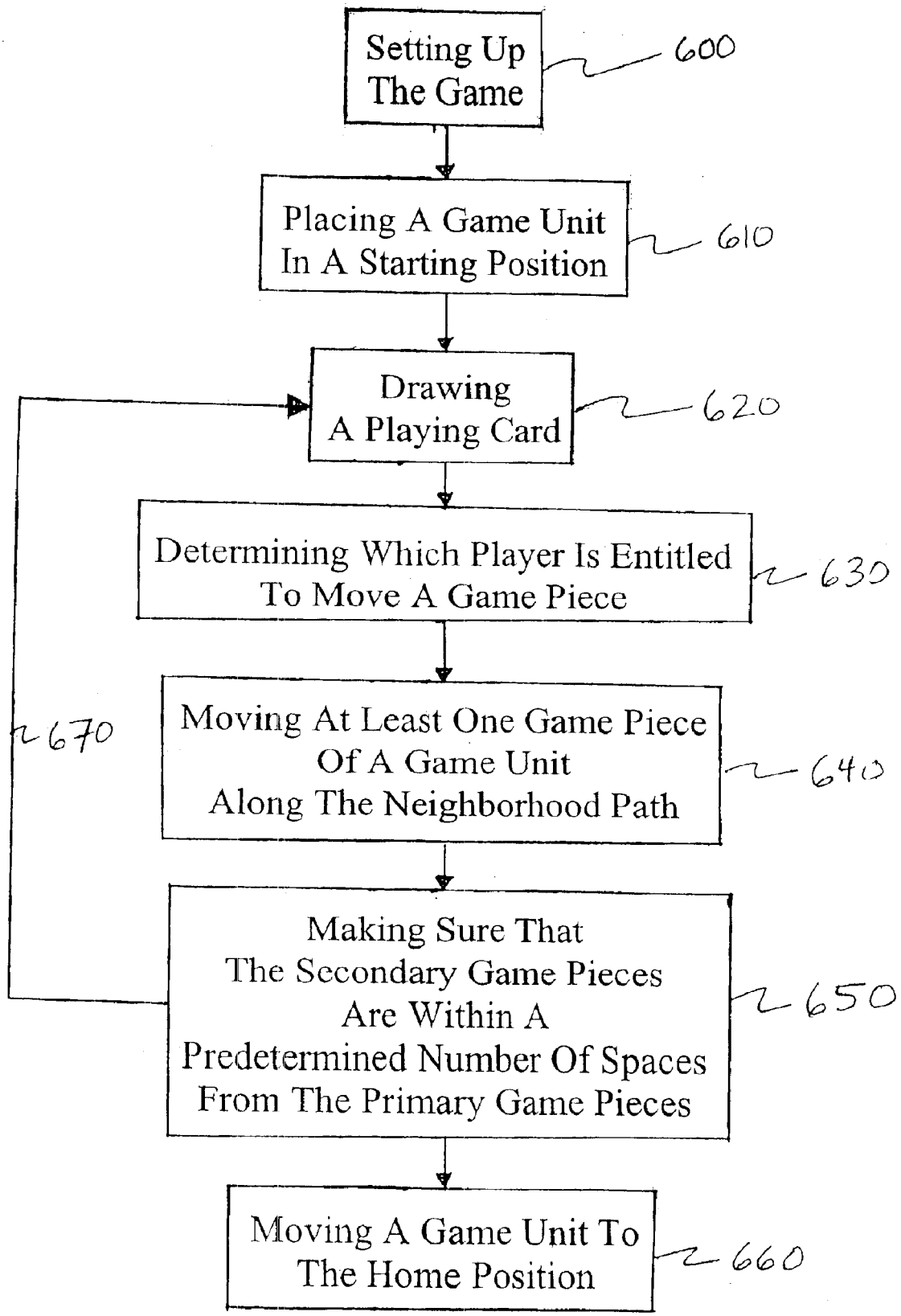
FIG. 6 is a flowchart illustrating a method of playing a preferred embodiment of the present invention.

In another embodiment, a method of playing is provided, as shown in FIG. 6, which involves setting up the game 600, placing a game unit in a starting position 610, drawing a playing card 620, determining which player is entitled to move a game piece 630, moving at least one game piece of a game unit along the neighborhood path 640, making sure that the secondary game pieces are within a predetermined number of spaces from the primary game pieces 650, moving a game unit to the home position 660.

Step 600: Setting up the game: Setting up the game involves designating one player to monitor the treat basket 22 and distributing a set number of treats per player, preferably five to ten treats. This step further involves shuffling a deck of playing cards 16 and chance cards 20, and placing the shuffled cards 16, 20 preferably at a designated location on a playing surface 82 as shown in FIG. 8.

Step 610: Placing a game unit in a starting position: This step involves selecting a game unit 4 and placing the game unit at a home position among the row of homes 54 on the playing surface 8. Preferably, before the first playing card 16 is drawn, all of the players should select a game unit 4 and place their game unit at a home position, Step 620: Drawing a playing card: Drawing a playing card preferably involves each player drawing a Halloween Card 30 and viewing the image 28 on the card 30.

Step 630: Determining which player is entitled to move a game piece: Determining which player is entitled to move a game piece 2 involves comparing the images 28 between the players' cards after each player practices Step 620. The player with the highest ranked image is entitled to move at least one game piece 2 from his game unit 4. If more than one player has the highest ranked image after all the players practice Step 620, then the player with the highest ranked image and highest number (on the upper left corner of the Halloween Card 26) is entitled to move at least one game piece 2. If two players draw a Halloween Wild Card 48 in the same round and choose to use the card 48 in that round, both players may move at least one game piece 2, but the player with the image of a Flying Witch on the card is entitled to move first. However, if the number of spaces shown on the Halloween Card 26 would force the player with the highest ranked playing card to violate the Safety Rule, the highest ranked player must forfeit a move and allow the player with the second highest ranked playing card to move.

Step 640: Moving at least one game piece of a game unit along the neighborhood path: The player entitled to move at least one game piece may move one of the pieces from his game unit 4 along the neighborhood path 52 a number of spaces 6 corresponding to the number on the upper left corner of the Halloween Card 26.

The player also preferably has the option of splitting a move amongst his game pieces. In the preferred embodiment, the player may split a move between two game pieces 2 if the number on the upper left corner of the Halloween Card 26 is an even number. The method may, however, include restrictions on the manner in which the move is divided among a player's game pieces. In the preferred embodiment, the player can move the second game piece only after the first game piece completes its move. For instance, if the player had a Halloween Card 30 with the number ten printed on the card, the player can move two game pieces 2 five spaces each. If in moving one of the game pieces 2, the first game piece lands on a Trick-or-Treat space 80, the player must draw a Trick-or-Treat Card 64 and follow the instruction of the card 64 before moving the second game piece five spaces.

If the playing card is a Halloween Wild Card 48, the player may move up to two game pieces 2 a certain number of spaces 6, preferably five spaces, in any direction along the neighborhood path 52 (e.g., forwards, backwards, or a combination of both). The player of a Halloween Wild Card 48 has the choice of also moving an opponent's game pieces along the neighborhood path 52.

Step 650: Making sure that the secondary game pieces are within a predetermined number of spaces from the primary game pieces: In one embodiment, the Safety Rule must be maintained throughout the game. If the Safety Rule is violated and discovered, the player is preferably penalized. In the preferred embodiment, the player in violation of the Safety Rule must forfeit a certain number of treats, preferably two treats, to each of the other players. The player in violation of the Safety Rule would also be required to move his game unit 4 to the location of his game piece 2 furthest from home position. If, however, the player does not intentionally violate the Safety Rule, the player in violation may move his game pieces 2 so that his game unit 4 complies with the Safety Rule. For instance, if a primary game piece 12 is sent to a space that causes a secondary game piece 14 to be in violation of the Safety Rule, the player of those game pieces may move that secondary game piece 14 to the closest primary game piece 12 of his game unit 4. If a secondary game piece 14 is sent to a space resulting in a violation of the Safety Rule, the player of the secondary game piece may move one of his primary game pieces 12 to the location of that secondary game piece 14. If, however, a secondary game piece 14 lands or is sent to the Witch House space 68, the player of the secondary game piece 14 is not subject to any penalties, but cannot move a primary game piece 12 to the Witch House space 60.

Step 660: Moving a game unit to the home position: As each game piece 2 completes the neighborhood path 52 around the playing surface 8, each piece 2 is moved to the home position. Once an entire game unit 4 has returned to the home position, the game ends and the player of the game unit at home position receives additional treats, preferably five to ten additional treats. The player with the most treats wins the game. If there is a tie, the player who moved his entire game unit to the home position wins.

The term "round of draws" refers to a condition when all of the players have practiced Steps 620, 630, 640, and 650 together in a single turn. Round of draws 670 are repeated until one player accomplishes Step 660.

As one can appreciate, the game of preferred embodiments of the present invention is a combination board game that involves both strategy and racing. Although the first to complete the neighborhood path 52 could win the game, this is not a necessary result. Players could force other players to be in violation of the Safety Rule delaying the end of the game for the purpose of accumulating and stock piling treats to win. Thus, while the Safety Rule may be a constraint, it may also be used by players as a strategic tool to win.

Figure 7:
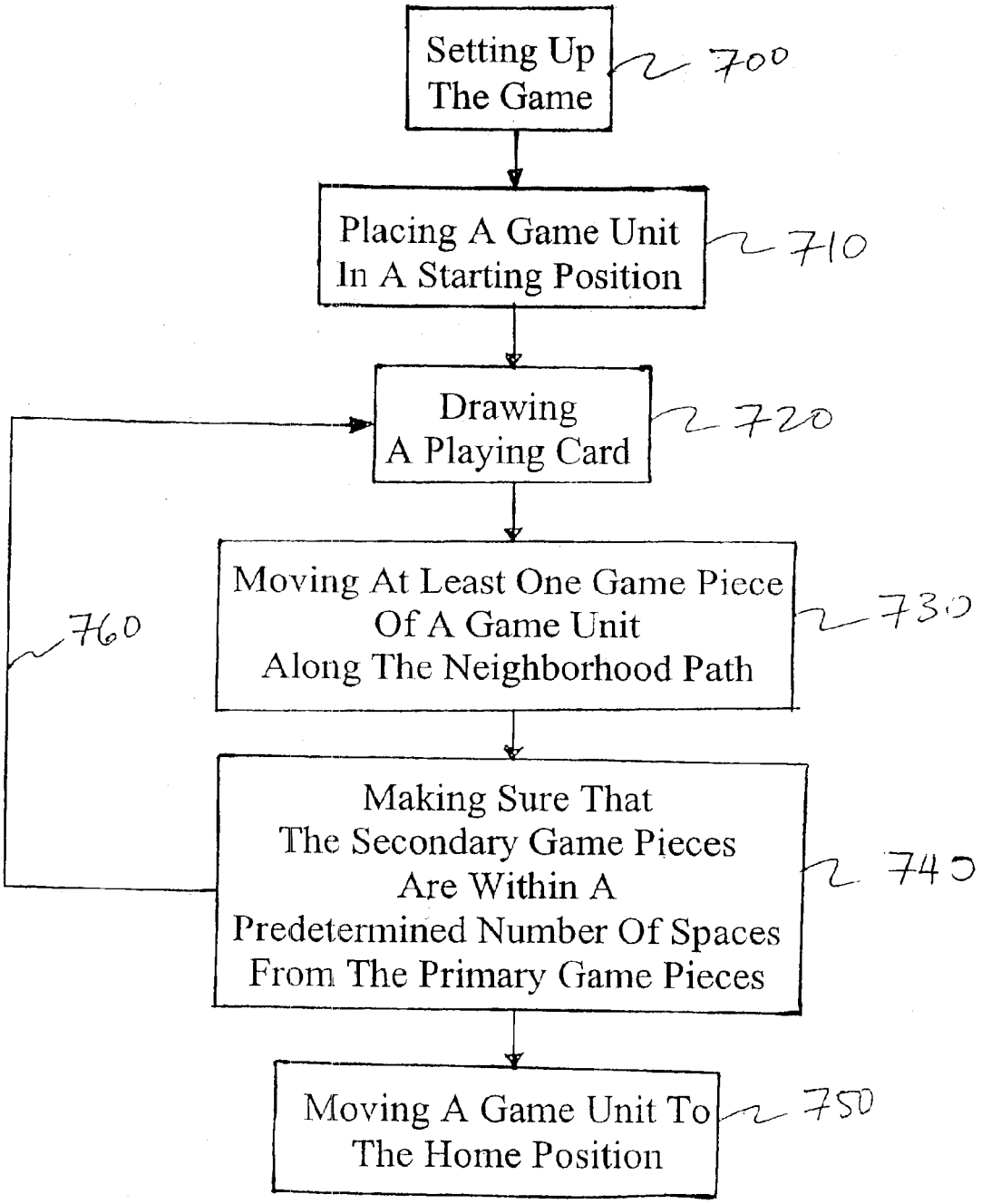
FIG. 7 is a flowchart illustrating a method of playing an alternative embodiment of the present invention.

In an alternative embodiment of playing the game, as shown in the flowchart of FIG. 7, the method involves setting up the game 700, placing a game unit in a starting position 710, drawing a playing card 720, moving at least one game piece of a game unit along the neighborhood path 730, making sure that the secondary game pieces are within a predetermined number of spaces from the primary game pieces 740, moving a game unit to the home position 750.

Step 700: Setting up the game: Setting up the game involves designating one player to monitor the treat basket 22 and distributing a set number of treats per player, preferably five to ten treats. This step further involves shuffling a deck of playing cards 16 and chance cards 20, and preferably placing the shuffled cards at a designated location on the playing surface, such as shown on the playing surface 82 in FIG. 8.

Step 710: Placing a game unit in a starting position: This step involves selecting a game unit 4 and placing the game unit at a home position among the row of homes 54 on the playing surface 8. Preferably, before the first playing card 16 is drawn, all of the players should select a game unit 4 and place their game unit at a home position. Each player would then preferably draw a Halloween Card 30. The player with the highest ranked card would preferably be entitled to move a primary game piece 12 from his game unit 4 to the Start space 58 and move first.

Step 720: Drawing a playing card: Drawing a playing card 16 preferably involves each player drawing a Halloween Card 30 and viewing the image on the card.

Step 730: Moving at least one game piece of a game unit along the neighborhood path: This step involves moving one of the game pieces 2 from the player's game unit 4 along the neighborhood path 52 a number of spaces corresponding to the number on the upper left corner of the Halloween Card 26. The player also preferably has the option of splitting a move amongst his game pieces. In the preferred embodiment, the player may divided the number of moves in half, splitting the move between two game pieces, if the number on the upper left corner of the Halloween Card 26 is an even number. The method may, however, have restrictions on the manner in which the move may be divided among game pieces. In the preferred embodiment, the player can move the second game piece only after the first game piece completes its move. For instance, if the player had a Halloween Card 30 with the number ten printed on the card, the player can move two game pieces 2 five spaces each. If in moving one of the game pieces 2, the first game piece lands on a Trick-or-Treat space 80, the player must draw a Trick-or-Treat Card 64 and follow the instruction of the card 64 before moving the second game piece five spaces.

If the playing card is a Halloween Wild Card 48, the player may move up to two game pieces 2 a certain number of spaces 6, preferably five spaces, in any direction along the neighborhood path 52 (e.g., forwards, backwards, or a combination of both). The player of a Halloween Wild Card 48 has the choice of also moving an opponent's game pieces 2 along the neighborhood path 52.

Step 740: Making sure that the secondary game pieces are within a predetermined number of spaces from the primary game pieces: In one embodiment, the Safety Rule must be maintained throughout the game. If the Safety Rule is violated and discovered, the player is preferably penalized. In the preferred embodiment, the player in violation of the Safety Rule must forfeit a certain number of treats, preferably two treats, to each of the other players. The player in violation of the Safety Rule would also be required to move his game unit 4 to the location of his game piece 2 furthest from home position. If, however, the player does not intentionally violate the Safety Rule, the player in violation may move his game pieces 2 so that his game unit 4 complies with the Safety Rule. For instance, if a primary game piece 12 is sent to a space that causes a secondary game piece 14 to be in violation of the Safety Rule, the player of those game pieces may move that secondary game 14 piece to the closest primary game piece 12 of his game unit 4. If a secondary game piece 14 is sent to a space resulting in a violation of the Safety Rule, the player of the secondary game piece 14 may move one of his primary game pieces 12 to the location of that secondary game piece 14. If, however, a secondary game piece 14 lands or is sent to the Witch House space 60, the player of the secondary game piece 14 is not subject to any penalties, but cannot move a primary game piece to the Witch House space 60.

Step 750: Moving a game unit to the home position: As each game piece 2 completes the neighborhood path 52 around the playing surface, each game piece 2 is moved to the home position. Once an entire game unit 4 has returned to the home position, the game ends and the player of the game unit at home position receives additional treats, preferably between five to ten treats. The player with the most treats wins the game. If there is a tie, the player who moved his entire game unit to the home position wins.

After the first player completes Steps 720, 730 and 740, the next player shall practice these same steps. Once this player completes these steps, the next player shall also practice Steps 720, 730, and 740. This process shall continue until all the players practice Steps 720, 730, and 740 once. The term "round of play" refers to each time all of the players practice Steps 720, 730, and 740 once. This round of play 760 is then repeated, preferably in a clockwise direction, until one player accomplishes Step 750.

Although the preferred embodiment is based on a Halloween theme, it will be appreciated that this concept could be applied to a variety of different themes or genres. For instance the concept could be applied to games involving a mission to rescue a stranded or injured person, going on a shopping spree with friends or family members, family outings, or any other situation that involves teamwork, cooperation, or family. Accordingly, it should be understood that certain variations and modifications of this invention will suggest themselves to one of ordinary skill in the art. The scope of the present invention is not to be limited by the illustrations or the foregoing descriptions thereof, but rather solely by the appended claims.

What is claimed is:

1. A method of playing a game comprising:

providing a plurality of game units, wherein each game unit has at least one primary game piece and at least one secondary game piece;

providing a playing surface having a plurality of spaces forming at least one path, wherein the spaces are sized to accommodate at least one game piece;

providing a plurality of playing cards, wherein at least one playing card has a number for indicating the number of spaces for which at least one game piece of one game unit may move;

providing a rule that requires the total number of spaces moved by all of the game pieces of one game unit to equal the number on the at least one playing card; and moving game pieces of a selected game unit along the spaces of the playing surface;

wherein at least one of the game pieces of a selected game unit, after being moved, remains within a predetermined number of spaces on the playing surface of another game piece of the selected game unit;

wherein the plurality of game pieces are configured to move separately from each other along the at least one path.

2. The method of claim 1, wherein the at least one secondary game piece and the primary game piece are configured to move separately along the path.

3. The method of claim 1, wherein the predetermined number is five spaces.

4. The method of claim 1, wherein each game unit has four game pieces.

5. A method of playing a game comprising:

providing a plurality of game units, wherein each game unit has at least one primary game piece and at least one secondary game piece;

providing a playing surface having a plurality of spaces forming at least one path, wherein the spaces are sized to accommodate at least one game piece;

providing a plurality of playing cards, wherein at least one playing card has a plurality of images oriented in specific locations along a surface of the at least one playing card, wherein the images are ranked according to the location of each image on the at least one playing card; and drawing a card and determining according to the rank of the card which player is entitled to move a game piece;

moving game pieces of a selected game unit along the spaces of the playing surface;

wherein at least one of the game pieces of a selected game unit, after being moved, remains within a predetermined number of spaces on the playing surface of another game piece of the selected game unit;

wherein the plurality of game pieces are configured to move separately from each other along the at least one path.

6. The method of claim 5, wherein one of the plurality of images is placed substantially near the center of the at least one playing card for designating the rank of the at least one playing card relative to the plurality of playing cards.

7. The method of claim 5, wherein the at least one secondary game piece and the primary game piece are configured to move separately along the path.

8. The method of claim 5, wherein each game unit has four game pieces.

9. The method of claim 5, further comprising selecting at least one playing card from the plurality of playing cards, wherein the at least one playing card has a number.

10. The method of claim 9, wherein moving the game pieces of a selected game unit involves moving one or both of the at least one primary game piece and the at least one secondary game piece of the selected game unit a certain number of spaces along the path corresponding to the number on the at least one playing card.

* * * * *